US005843613A

United States Patent [19]

Fujiwara et al.

[11] Patent Number: 5,843,613

[45] Date of Patent: Dec. 1, 1998

[54] LIQUID DEVELOPER

[75] Inventors: Toshimitsu Fujiwara, Kobe; Shuji Iino, Muko; Hidetoshi Miyamoto, Takatsuki, all of Japan

[73] Assignee: Minolta Co., Ltd., Osaka, Japan

[21] Appl. No.: 601,776

[22] Filed: Feb. 15, 1996

[30] Foreign Application Priority Data

Feb. 16, 1995 [JP] Japan ..... 7-028187
Feb. 16, 1995 [JP] Japan ..... 7-028188

[51] Int. Cl.[6] ..... G03G 9/125

[52] U.S. Cl. ..... 430/114; 430/116

[58] Field of Search ..... 430/114, 115, 430/116

[56] References Cited

U.S. PATENT DOCUMENTS 3,990,980 11/1976 Kosel ..... 430/116
4,120,805 10/1978 Yamashita et al. ..... 430/114
4,547,449 10/1985 Alexandrovich et al. ..... 430/116
4,794,651 12/1988 Landa et al. ..... 430/110
4,984,025 1/1991 Landa et al. ..... 355/274
4,985,732 1/1991 Landa et al. ..... 355/256
4,999,677 3/1991 Landa et al. ..... 355/273

*Primary Examiner*—John Goodrow
*Attorney, Agent, or Firm*—McDermott, Will & Emery

[57] ABSTRACT

The present invention provides a liquid developer for electrophotography comprising: carrier liquid, and toner particles, dispersed in the carrier liquid, formed of binder resin and colorant, wherein said carrier liquid contains acidic dispersion resin and basic dispersion resin which are soluble in said carrier liquid. Further, the present invention provides a liquid developer for electrophotography comprising: carrier liquid, and toner particles, dispersed in the carrier liquid, formed of binder resin and colorant, wherein said liquid developer contains a basic dispersion resin that is soluble in said carrier liquid and has a moisture content of 500~20,000 ppm, and has an acidic group on the surface of the toner particle.

24 Claims, 1 Drawing Sheet

LIQUID DEVELOPER

BACKGROUND OF THE INVENTION

1. Field of the Invention

The present invention relates to a liquid developer for electrophotography for developing electrostatic latent images formed on an electrostatic latent image-bearing member.

2. Description of the Related Art

Electrophotographic methods can be broadly divided into dry type developing methods and wet type developing methods. In wet type developing method which use toner contained in a liquid, it is possible for the size of the toner particles to be in the submicron range, whereas fine detail images cannot be obtained in dry type developing methods. Wet type developers also are advantageous in that they offer excellent halftones and are easily fixed.

Normally, liquid developers comprise a suspension dispersion of charged colored microparticles (toner particles) dispersed in a carrier liquid having a high volume resistivity of $10^{10}$ Ω·cm or greater, e.g., paraffin hydrocarbons, halogen hydrocarbons, polysiloxane or like solutions. The colored microparticles in this solution electrophoretically migrate to an electrostatic latent image formed on the surface of a latent image-bearing member such as a photosensitive member or electrostatic sheet or the like so as to accomplish development by electric force.

Organic acids of metal salts, soluble macromolecules having a polar group, nitrogen compounds or lecithin surface-active agents or the like dissolved or dispersed in carrier liquid have been studied for the purpose of controlling the charge polarity or charging level of toner particles. For example, Japanese Examined Patent Application No. SHO 51-40465 discloses a liquid developer wherein a basic polymer comprising structural monomer of N-vinyl-2-pyrrolidone is dissolved in a liquid carrier as a charge-control agent. Furthermore, Japanese Examined Patent Application No. SHO 59-37826 discloses a liquid developer wherein a polymer having an ethylene unsaturated compound possessing a morpholine group was added to a carrier liquid as a pigment dispersing agent having charge-controlling characteristics.

Even developers containing the aforesaid charge-control agents, however, have reduced dispersed stability based on the charge controlling effectiveness, which makes it difficult to obtain adequate image density (hereinafter referred to as "ID"). The cause of this difficulty is believed to be that the colored microparticles cannot be adequately charged due to the presence of units of unreleased ions of basic polymers and pigment dispersing agents acting as charge-control agents in the carrier liquid.

Ricoh Technical Report No. 9, 22 (1993) discloses a liquid developer wherein a pyridine monomer unit and acidic colored particles containing abietic acid, lauryl methacrylate, and glycidyl methacrylate are added to a developing liquid, and reports the acidic colored microparticles in the developing liquid are charged with a negative polarity. In the aforesaid construction, although an improvement in charging characteristics of the colored microparticles is obtained which poses not practical problem with respect to obtaining a suitable image density, the electrophoretic migration speed of the colored microparticles is extremely slow, making it unsuitable for use in high-speed systems such as high-speed copying machines and printers.

SUMMARY OF THE INVENTION

An object of the present invention is to provide a novel and useful liquid developer.

Another object of the present invention is to provide a liquid developer having excellent charging characteristics.

Another object of the present invention is to provide a liquid developer having excellent electrophoretic migration and developing speed.

Yet another object of the present invention is to provide a liquid developer having excellent environmental stability.

A further object of the present invention is to provide a liquid developer which achieves excellent image density.

A still further object of the present invention is to provide a liquid developer having excellent high-precision reproduction characteristics.

An even further object of the present invention is to provide a liquid developer having excellent fixing characteristics over a broad anti-offset range.

A still further object of the present invention is to provide a liquid developer that maintains an adequate developing speed when used in high-speed printing apparatus other than copying machines, printers and the like, and achieves high precision reproduction with high image density.

The present invention pertains to a liquid developer comprising, dispersed in an electrically insulated carrier fluid, toner particles formed of binder resin and colorant, and acidic dispersion resin and basic dispersion resin which are soluble in said carrier liquid.

The present invention pertains to a liquid developer for electrophotography comprising toner particles formed of at least binder resin and colorant dispersed in a high resistance carrier liquid, and wherein said liquid developer for electrophotography contains a basic dispersion resin soluble that is in said carrier liquid and has a moisture content of 500–20,000 ppm in the liquid developer, and has an acidic group on the surface of the toner particle.

Figure 1:
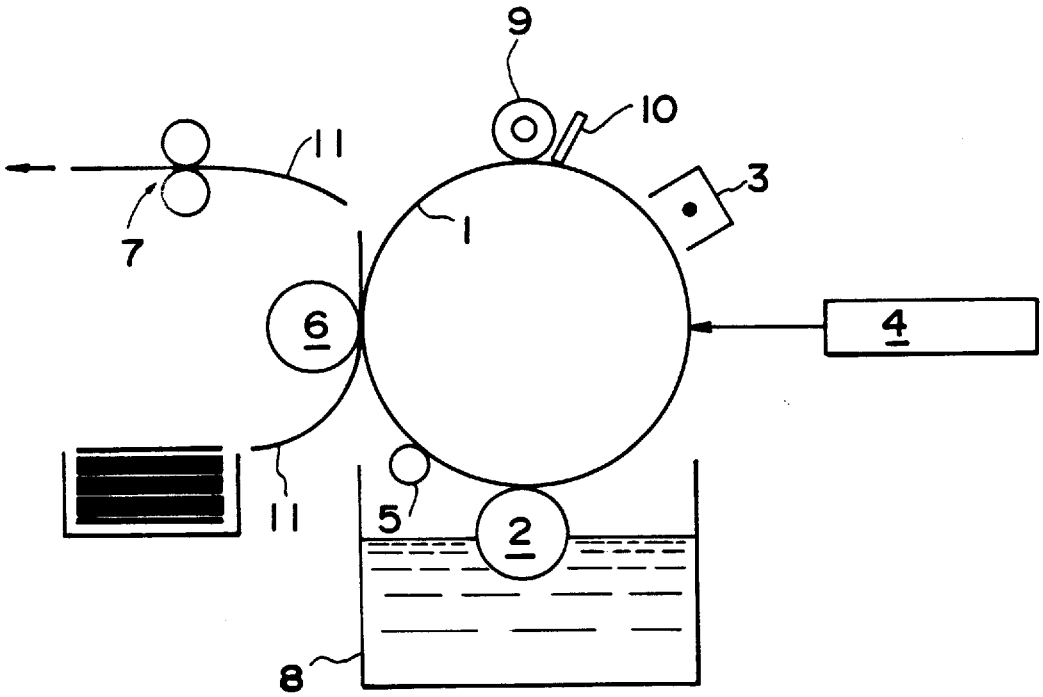
FIG. 1 briefly shows an image forming apparatus provided with a liquid developing device.

The present invention will be fully described hereinafter by way of the preferred embodiments with reference to the accompanying drawing.

DETAILED DESCRIPTION OF THE PREFERRED EMBODIMENTS

The reduction in developing speed that occurs when liquid developer is used is believed to be caused by the frequency of impact of toner particles and counter ion particles.

That is, in the case of a two-component construction of toner particles and basic dispersion resin, a charge occurs between the toner particles and basic resin in the carrier liquid, such that the toner particles generally are negatively charged and the basic resin (counter ion particles) are positively charged. The potential difference between the photosensitive member and the developing electrode which imparts a positive charge on the photosensitive member causes the toner particles to electrophoretically migrate to the photosensitive member and the basic dispersion resin to electrophoretically migrates to the developing electrode, thereby accomplishing development. In the carrier liquid, the toner particles and the basic dispersion resin mutually collide one with another due to their mutually opposite charges and migration in mutually opposite directions. These collisions neutralize the charge maintained by the particles, causing the particle migration to cease and excessively slowing the migration speed. The particle migration is temporarily interrupted until the particles can be recharged, thereby reducing the developing speed. Accordingly, the reduction of developing speed can be improved by decreasing the frequency of collisions between the toner particles and basic dispersion resin (counter ion particles) so as to accomplish development without interrupting toner particle migration. As previously described, the liquid developer of the present invention comprises three components including toner particles, basic dispersion resin, and acidic dispersion resin. In this construction, when, for example, the toner is negatively charged, the acidic dispersion resin is charged with the same negative charge as the toner particles in the carrier liquid, and migrate in the opposite direction to that of the positively charged basic dispersion resin. Accordingly, the basic dispersion resin the frequency of collisions between the toner particles and basic dispersion resin is markedly reduced because the basic dispersion resin collides with the acidic dispersion resin rather than the toner particles. The toner particles maintain their charge and migrate to the photosensitive member with high efficiency, thereby improving developing speed. Furthermore, although the toner particles collide with the acidic dispersion resin, charge neutralization does not occur despite the collisions because both particles are charge with the same polarity, such that toner particle migration speed, i.e., developing speed of the liquid developer, is not adversely affected.

Therefore, in the preferred embodiments of the present invention, developing speed is greatly improved by improving toner particle charging characteristics by adhering basic dispersion resin sufficiently on the toner particle surface, and improving the charge neutralization-induced reduction in toner particle migration speed by decreasing the frequency of collision between the toner particles and basic dispersion resin by the combined use of the acidic dispersion resin in the carrier liquid.

Although the description above has been developed in terms of a negative charging toner, it is possible to use a positive charging toner in the present invention. In the case of positive charging toner, the acidic dispersion resin is absorbed on the toner particle surface to improve the positive charging characteristics of the toner particles, and the basic dispersion resin acts to improve the reduction in toner particle migration speed. The viscosity of the carrier liquid can be regulated by the total amount of acidic dispersion resin and basic dispersion resin, so as to control the dispersion stability of the toner particles in the carrier liquid.

The toner particles dispersed in the carrier liquid in the liquid developer of the present invention are described hereinafter.

The toner particles are colored particles comprising pigment or dye and various types of additive agents as necessary in resin microparticles, and may be manufactured by suitably selecting from among conventional methods for producing resin of a desired particle size or shape. Examples of useful manufacturing methods include wet pulverization methods, emulsion dispersion methods, spray drying methods, emulsion polymerization methods, methods for anchoring pigment on the surface of fine resin particles obtained by well-known methods,or methods for coloring fine resin particles by dyes dissolved in solution but without actually dissolving the fine resin particles. Specific devices for anchoring pigments to the surface of resin microparticles include a hybridization system (Nara Kikai Seisakusho), Angmill (Hosokawa Micron), Dispacoat (Nisshin Engineering) and the like. Spray drying methods are most desirable for producing fine resin particles. Spray drying methods are advantageous in that they allow easy regulation of the size of the obtained resin particles by regulating conditions such as resin solution concentration, spray pressure and the like, so as to obtain fine resin particles having a narrow size distribution. Spray drying methods further produce fine resin particles without impurities because surface-active agents are not used, and therefore cause no loss of effectiveness of the various types of dispersion resins added for charging characteristics in the present invention. Colored resin obtained by fusion kneading of a colorant and binder resin may be coarsely pulverized to about 1 mm particle size, then finely pulverized by dry-type fine pulverization devices such as a jet mill, or a coarsely pulverized material in solvent may be finely pulverized using a wet-type media mill. Typical dry-type pulverization methods include the jet mill (Japan Pneumatic), and Criptron (Kawasaki Heavy Industries). Wet-type media mills include Mitsubishi model UF mill (Mitsubishi Heavy Industries), Eiger mill (Eiger Japan) and spike mill (Inoue Seisakusho).

The most desirable method for producing toner particles for use in the liquid developer of the present invention is the aforesaid fusion kneading method which is not susceptible to charge fluctuation due to colorant. Wet type pulverization method is also desirable wherein an isoparaffin solvent is used with a media mill. This method is particularly effective in developers used in full color developing which simultaneously use toner of a plurality of different colors. That is, the amount of development of the various colors is not stable in full color developing due to different charging characteristics of each color caused by different types of colorants, such that problems may easily arise regarding color reproducibility. These problems can be eliminated, however, in the aforesaid method by suppressing the amount of exposure of the colorant which covers the resin through using a toner which has a colorant dispersed in the fine resin particles.

The methods for manufacturing the toner particles are not specifically limited to the aforesaid methods insofar as such methods are capable of producing particles wherein colorants (e.g., pigments and dyes) and other additives are contained in the resin. The charging polarity may be either positive or negative.

Specifically, examples of well known organic dyes and pigments and inorganic pigments of various colors include colorants such as carbon black, and C.I. pigment blue 15-3, C.I. pigment yellow 17, C.I. pigment red 122, and Mogal L. These colorants are typically used at a rate of 3~30 parts-by-weight, and preferably 5~20 parts-by-weight relative to 100 parts-by-weight of binder resin. When the amount of said colorants exceeds 30 parts-by-weight, toner fixing characteristics are impaired, whereas when the amount os less than 3 parts-by-weight the desired image density cannot be obtained.

When the mean particle size of the toner particles is too small, the amount of basic dispersion resin or acidic dispersion resin absorbed in the carrier liquid is quite small due to the small surface area per particle, such that an adequate charge cannot be obtained. Furthermore, there is concern that an adequate image density will not be obtained above a certain system speed because the developing speed is decreased due to excessively slow toner particle migration. On the other hand, when the mean particle size is too large, fine detail images cannot be obtained at high resolution. Accordingly, the volume-average particle size of the colored microparticles is desirably in a range of 0.5~5.0 $\mu$m, and preferably 1.0~3.0 $\mu$m. The measured values of all the volume-average particle sizes in the present embodiment are measured using a model SALD-1100 (Shimadzu).

The binder resin used for the toner particles in the liquid developer of the present invention may be binder resin used in typical toners. Examples of useful binder resins include polyester resin, styrene-acrylic copolymer, polystyrene, polyvinylchloride, polyvinylacetate, polymethacrylate ester, polyacrylate ester, epoxy resin, polyethylene, polyurethane, polyamide, paraffin wax and the like used individually or in combinations of two or more. Polyacrylate, polymethacrylate or polymers thereof may be added to regulate the amount of functional group present on the surface of the resin. Since liquid developing methods do not charge the toner particles (colored microparticles) via friction with a charging member such as carrier particles as do dry-type developing methods, resin properties must be selected with consideration given to fusion of particles and spent toner particles. Therefore, in the liquid developer of the present invention, low melting point resins may be used to reduce the amount of heat required for fixing.

The acidic and basic dispersion resins are discussed below.

The basic dispersion resin and acidic dispersion resin used in the liquid developer of the present invention may be polymers or copolymers generated from a base monomer or acid monomer containing a basic or acidic functional group, respectively, and are not specifically limited insofar as said materials are soluble in the electrically insulated carrier liquid described later.

Examples of useful nitrogen containing basic monomers which can be used as the basic monomer for the basic dispersion resin include (meta) acrylates having an aliphatic amino group such as N,N-dimethyl aminoethyl(meta) acrylate, N,N-diethyl aminoethyl(meta) acrylate, N,N-dibutylaminoethyl (meta) acrylate, N,N-hydroxyethylamino (meta) acrylate, N-ethylaminoethyl(meta) acrylate, N-octyl, N-ethylaminoethyl(meta) acrylate, N,N-dihexylamino ethyl (meta) acrylate, (meta)acrylamides such as N-methylacrylamide, N-octylacrylamide, N-phenylmethyl acrylamide, N-cyclohexyl acrylamide, N-phenyl acrylamide, N-p-methoxyphenyl acrylamide, N,N-dimethyl acrylamide, N,N-dibutyl acrylamide, N-methyl,N-phenyl acrylamide and the like, aromatic substituted ethylene monomers having a nitrogen group such as dimethylamino styrene, diethylamino styrene, dimethylaminomethyl styrene, dioctylamino styrene and the like, and nitrogen containing vinyl ether monomers such as vinyl-N-ethyl-N-phenylamino ethyl ether, vinyl-N-butyl-N-phenylamino ethyl ether, triethanolamine divinyl ether, vinyldiphenylamino ethyl ether, N-vinylhydroxyethyl benzamide, m-aminophenylvinyl ethers and the like. Examples of the most suitable nitrogen containing basic monomers include nitrogen containing heterocyclic compounds, among which the most desirable include pyroles such as N-vinylpyrole, pyrrolines such as N-vinyl-2-pyrroline, N-vinyl-3-pyrroline and the like, pyrrolidines such as N-vinylpyrrolidine, vinylpyrrolidine amino ether, N-vinyl-2-pyrrolidone and the like, imidazoles such as N-vinyl-2-methylimidazole and the like, imidazolines such as N-vinylimidazoline and the like, indoles such as N-vinylindole and the like, carbazoles such as N-vinylcarbazole, 3,6-dibromo-N-vinylcarbazole and the like, pyridines such as 2-vinylpyridine, 4-vinylpyridine, 2-methyl-5-vinylpyridine and the like, quinolines such as (meta)acrylate piperazine, N-vinylpiperidone, N-vinylpiperazine and the like, quinolines such as 2-vinylquinoline, 4-vinylquinoline and the like, pyrazoles such as N-vinylpyrazole, N-vinylpyrazoline and the like, oxazoles such as 2-vinyloxazole, 2-vinyloxazole and the like, oxazines such as 4-vinyloxazine, morpholinoethyl (meta) acrylate and the like. The basic backbone structure is essentially comprised at least of the aforesaid types of structures, although various types of functional groups may be added and substituted insofar as they are basic. The basic dispersion resins used in the liquid developer of the present invention may be polymers or copolymers of the previously mentioned monomers. Examples of monomers useful for copolymerization with the previously mentioned nitrogen containing monomers include hexyl(meta) acrylate, cyclohexyl(meta) acrylate, 2-ethylhexyl(meta) acrylate, octyl(meta) acrylate, nonyl(meta) acrylate, decyl(meta) acrylate, dodecyl(meta) acrylate, lauryl(meta) acrylate, stearyl(meta) acrylate, vinyl laurate, vinyl stearate, benzyl (meta) acrylate, phenyl(meta) acrylate, styrene, vinyl toluene and the like. Among the aforesaid, the most desirable include basic dispersion resins using monomers having a basic backbone structure such as pyrolizine, oxazine and the like. For example, random copolymers or graft copolymers of methacrylate ester having an alkyl group with 10–20 carbon atoms, and N-vinylpyrolidone or dimethylaminoethyl methacrylate are desirable.

These monomer components having nitrogen atoms of the basic copolymers containing nitrogen atoms desirably comprise 0.1 to 30 percent-by-weight, and preferably 0.5 to 20 percent-by-weight, in the copolymer content.

The solubility in carrier liquid and control of basicity of these polymers and copolymers can be readily controlled by regulating the substitution groups of the monomer component, and changing the percentage of the copolymer component.

The amount of added basic polymer containing nitrogen atoms is desirably 1 to 80 percent-by-weight, and preferably 10 to 70 percent-by-weight, with respect to the toner particles.

On the other hand, examples of acidic monomers useful for constructing the acidic dispersion resin include monomers having a carboxyl group such as acrylic acid, methacrylic acid, itaconic acid, maleic acid, vinyl acetate, vinyl glycogen, vinyl acrylate, vinyl benzoate and the like, metal salts thereof (e.g., Li, Na, K, Ca, Mg, Al), monomers having sulfonic groups and sulfinic groups such as vinyl sulfonic acid, vinyl benzene-sulfonic acid, vinyl benzylsulfonic acid, vinylbenzene-sulfinic acid, and metal salts thereof, as well as monomers having functional groups exhibiting acidity such as phosphoric acid and the like used individually or in combinations of two or more.

The amount of added dispersion resin differs in accordance with the type, molecular weight, and polar group of the dispersion resin, and while said added amount cannot be standardized, an amount of 0.1 to 20 percent-by-weight, and 0.1 to 10 percent-by-weight is more desirable, relative to the dispersion resin is desirable. When the amount of added dispersion resin is excessive, the viscosity of the liquid becomes higher, which makes it difficult for the toner particles to move within the liquid. When the amount of added dispersion resin is too little, the toner particles are insufficiently charged, which causes adverse effects on image quality due to fog and the like. The ratio of added basic dispersion resin and acidic dispersion resin is desirably 1:5 to 5:1, preferably 1:2 to 2:1, and ideally 1:1.

In the present embodiment, the amounts of added acidic dispersion resin and basic dispersion resin may be regulated to control the charging characteristics, migration speed, and dispersion stability of the toner particles to desired values.

The aforesaid dispersion resins may be produced by a variety of conventional and well known methods including solution polymerization, emulsion polymerization, bulk polymerization and the like. Polymerization may be accomplished using well known suitable materials as a polymerization catalyst to accelerate radical generation including peroxides such as benzoyl peroxide, and azobis compounds such as azobisisobutylnitrile and the like.

The liquid developer for electrophotography of the present invention is regulated by dispersing the aforesaid resin particles in a carrier liquid in which the basic dispersion resin and acidic dispersion resin have been dissolved beforehand.

It is desirable that the carrier liquid used have a resistance value which does not disrupt the electrostatic latent image of the photosensitive member or the like, i.e., a resistance of $10^{11}$~$10^{16}$ Ωcm is desirable, and a value of $10^{12}$~$10^{16}$ Ωcm is preferable. It is also particularly desirable that the solvent used be odorless and nontoxic, and have a relatively high ignition point. The carrier liquid may be in any state at room temperature insofar as said carrier liquid is in a liquid state when used as a dispersion medium. For example, aliphatic hydrocarbons, alicyclic hydrocarbons, aromatic hydrocarbons, halogenated hydrocarbons, polysiloxanes and the like are useable, but isoparaffin solvents are preferable from the perspectives of nontoxicity, odorlessness, and cost. Specific examples include isobar G, isobar H, isobar K (Esso), Shelzol 71 (Shel Oil Co.), IP solvent 1620, IP solvent 2028 (Idemitsu Sekiyu).

The concentration of toner particles relative to carrier liquid is desirably 0.5 to 50 percent-by-weight, and preferably 2 to 10 percent-by-weight, from the perspectives of developing speed and image fog and the like. This concentration is the concentration at the time of developing, and the concentration may be higher during storage, replenishment, and shipment.

In the present invention, the degrees of solubility, basicity, and acidity of the carrier liquid of the aforesaid dispersion resins can be readily controlled by changing the percentage copolymer components and regulating the substituted groups of the monomer components constructing the dispersion resin.

The preferred embodiments of the present invention have a structure wherein a predetermined amount of moisture and basic dispersion resin are present in the carrier liquid, and acidic groups are present on the surface of the toner particles.

Selection of similar structures provides a liquid developer that normally produces a high image density, stable charging characteristics, and which is not susceptible to change over time or environmental fluctuations. Furthermore, a liquid developer is provided that does not cause an offset phenomenon during fixing by a heating roller. Still further, a liquid developer is provided that produces excellent image density and image quality rich in fine details.

Through investigation the present inventors have discovered that major factors supporting charging characteristics of the toner particles in liquid developers are the amount of moisture, degree of basicity of the dispersion resin, and the acidic group on the surface of the toner particles, and that suitably stable toner charge can be obtained when the aforesaid three factors are satisfied.

That is, the preferred embodiments of the present invention relate to a liquid developer for electrophotography having toner particles comprising at least binder resin and colorant dispersed in a carrier liquid having a high resistance, wherein said liquid developer for electrophotography has a moisture content of 500 to 20,000 ppm, contains a basic dispersion resin soluble in the carrier liquid, and has an acidic group on the surface of the toner particles.

The present invention is based on actual experiments, during the course of which it was discovered that the toner particle charge can be controlled when there is a predetermined amount of moisture and basic dispersion resin present in the carrier liquid, and an acidic group is present on the surface of the resin particle. The present inventors found a correlation between the amount of toner charge and the degree of acidity on the surface of the toner particles in the presence of a predetermined amount of moisture and a basic dispersion resin, and further found that the amount of toner charge increases with increased acidity. This correlation was not observed, however, when the moisture content was even slightly below said predetermined amount even in the presence of a basic dispersion resin and acidic group on the surface of the toner particles, such that not only is the amount of toner charge not controllable but fluctuations due to changing environmental conditions and changes over time in the amount of toner charge were extreme. Furthermore, inadequate toner charging occurs when basic dispersion resin is not present, or when an acidic group is not present on the surface of the toner particles, even if a particular amount of moisture is present.

During multiple investigations of offset prevention during which moisture was aggressively added to the liquid developer, the present inventors experimentally confirmed that when the moisture content exceeds a predetermined amount in the presence of basic dispersion resin, a saturation condition is attained which affects chargeability. The inventors discovered that a liquid developer can be obtained which provides stable charging characteristics over a long term and which is unsusceptible to temperature and humidity changes in the surrounding environment by using toner particles that have an acid group on the surface.

In the present invention, the amount of charge was stabilized by the amount of moisture in the liquid developer, presence of basic dispersion resin, and presence of acid group on the surface of the toner particles is discussed below.

Most of the moisture added to the liquid developer is believed to be selectively concentrated near the surface of the toner particles, such that a polar medium atmosphere occurs only near the surface of the toner particles even in a nonpolar carrier liquid. Thus, it is believed that protons are released from the surface of the toner particles by the acid-base interaction between the acid group on the surface of the toner particle and the base group of the basic dispersion resin present in the carrier liquid, so as to negatively charge the toner particles in the carrier liquid. Although the charging mechanism is extremely complex and many aspects remain unclear, it is known that a correlation occurs between the amount of toner charge and the degree of acidity of the toner particle surface because the proton release equilibrium tends to increase and accelerate as the degree of acidity of the toner particle surface increases. When basic dispersion resin is not present in the carrier liquid, however, proton release equilibrium is greatly inhibited to the point that the proton release at the surface of the toner particle does not occur, and results in inadequate charging of the toner.

The carrier liquid used in the liquid developer has a high resistance, and original moisture content of several tens of parts per million even in a low dielectric liquid medium. It is believed that the acid-base interaction, which occurs between the base groups of the basic dispersion resin present in the carrier liquid and the acid group present on the surface of the toner particle via the slight moisture content, gives rise to the release of protons from the toner particle surface so as to negatively charge to a certain degree the toner particles in the carrier liquid. It is surmised that not only is charging inadequate under a slight moisture content, but that charging characteristics change markedly in response to slight variations in the moisture content of the liquid developer.

It is further believed that it is possible to control the amount of toner charge by controlling the degree of acidity of the toner particle surface by aggressively adding moisture to the liquid developer in excess of the amount of moisture which achieves a saturation state of the toner charge in the liquid developer, so as to obtain a liquid developer having excellent stability over a long term use, and which exhibits stable charging characteristics with respect to slight changes in moisture content of the liquid developer caused by fluctuating environmental conditions of temperature and humidity.

The present invention is described in detail below.

According to the present invention, the moisture content of the liquid developer is suitable within a range of 500 to 20,000 ppm, and preferably within a range of 1,000 to 15,000 ppm. When the moisture content is less than 500 ppm, charging characteristics are readily changed by changes in the temperature and humidity of the surrounding environment despite regulation of the acidity of the toner particle surface, whereas when the moisture content exceeds 20,000 ppm, toner particle dispersibility is adversely affected by the influence of the moisture in the system, such that the volume resistivity of the liquid developer is reduced due to the increase in moisture present beyond the vicinity of the toner particle surface, thereby causing deterioration of charging characteristics and causing image drift and the like. In the present invention, moisture content was measured by the Karl Fischer technique. Excellent offset characteristics are obtained with a moisture content of 500 to 20,000 ppm.

In this case, the volume resistivity of the liquid developer is desirably $10^{10}$ to $10^{15}$ Ωcm, and preferably $10^{12}$ to $10^{15}$ Ωcm. The resistance of the liquid developer can be optimized by providing a volume resistivity of 1010 Ωcm or greater, so as to minimize image drift and the like.

The toner binder resin used for the parent body toner particles may be any of the binder resins described previously to provide a structure having an acid group present on the toner particle surface.

Toner particles using the aforesaid binder resins must have an acid group on the surface of the particle so as to provide adequate chargeability by acid-base interaction with the basic dispersion resin.

Methods for providing an acid group on the toner particle surface include (1) methods using a resin having an acid group as the toner binder resin, (2) methods which add compounds having an acid group within the toner binder resin, and (3) methods which anchor acid microparticles on the surface of the toner binder resin.

Methods of type (1) using resins having an acid group as the binder resin are specifically described below. In the case of styrene-acrylic resins it is possible to use resins utilizing acidic monomers such as (meta) acrylic acid and the like as copolymerization monomers, and the acid value can be controlled by controlling the percentage of the acid monomer. It is also possible to use polyester resin, and the acid value can be controlled by controlling the graft percentage of small graft polymerized acid monomers. General methods may use a blend of acidic resin added to a resin not having an acid group. In this case, the acid value of the binder resin is desirably 5 to 100 mgKOH/g. When the acid value is less than 5, adequate charging is not obtained and the charge easily becomes unstable, whereas when the acid value exceeds 100, not only is it difficult to obtain suitable image density due to the excessively high toner charge, but transfer and cleaning problems also arise. That is, developing speed and transfer characteristics requirements can both be satisfied by having a toner charge in the range of 10~100 μC/g. The acid value of the binder resin in the present invention is determined as follows. Five grams of resin is dissolved in 50 ml neutral solvent (toluene-EtOH (2/1)), and thereafter 0.04M of KOH-EtOH solution is titrated. Phenolphthalein is used as an indicator.

Acid value=(a–b) X f X 2.244/w [where a is the fine red endpoint (ml); b is the blank test titration (ml); f is the strength of the solution 0.04M KOH-EtOH; w is the amount of specimen resin (g)] Examples of compounds having an acid group added within the binder resin of the toner of type (2) above, include organic acids such as carbonic acid, sulfonic acid, phosphoric acid and the like, microparticles of inorganic acid compounds such as higher fatty acids and silica microparticles and the like, resin acids such as rosin and the like and derivatives thereof.

Examples of acidic microparticles anchored to the toner particle surface of type (3) above include acidic inorganic acid compounds such as silica microparticles and the like, and microparticles of vinyl polymers or copolymers having an acid group. Specific apparatuses for anchoring acidic microparticles to the surface of toner particles include a hybridization system (Nara Kikai Seisakusho), ANGMILL (Hosokawa Micron), Dispacoat (Nisshin Engineering) and the like.

The previously mentioned basic dispersion resins can be used as the basic dispersion resin dispersed in a carrier liquid in the liquid developer of the present invention.

Experimental Examples

Specific experimental examples of the present invention are described below. In the following examples "parts" designate "parts-by-weight" unless otherwise specified.

Production of Basic Dispersion Resin a

Basic dispersion resin a comprising a basic heterocyclic compound containing nitrogen atoms was obtained by combining 100 parts IP solvent 1620 (volume resistivity: $1.5\times10^{14}$ Ωcm; Idemitsu Sekiyu Kagaku), 47 parts lauryl methacrylate having the chemical structure of [I] below, 3 parts N-vinyl-2-pyrolidone having the chemical structure of [II] below as a basic monomer, and 0.2 parts azobisisobutylonitrile as a polymerization initiating agent, and reacting said materials in a nitrogen atmosphere at a reaction temperature of 60°~70° C. for about 12 hr.

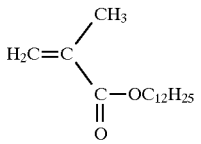

[I]

-continued

[II]

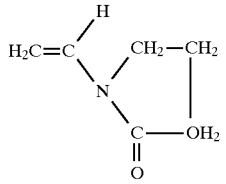

Production of Basic Dispersion Resin b

Basic dispersion resin b was produced in the same manner as basic dispersion resin a with the exception that 47 parts of stearyl methacrylate having the chemical structure of [III] below was substituted for the lauryl methacrylate of dispersion resin a.

[III]

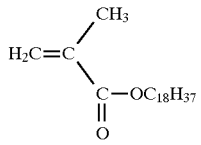

Production of Basic Dispersion Resin c

Basic dispersion resin c was produced in the same manner as basic dispersion resin a with the exception that 3 parts of morpholinoethyl methacrylate having the chemical structure of [IV] below was substituted for N-vinyl-2-pyrrolidone as the basic monomer of dispersion resin a.

[IV]

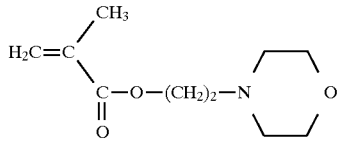

Production of Basic Dispersion Resin d

Basic dispersion resin d was produced in the same manner as basic dispersion resin a with the exception that 3 parts of 2-vinylpyridine having the chemical structure of [V] below was substituted for the N-vinyl-2-pyrrolidone as the basic monomer of dispersion resin a.

[V]

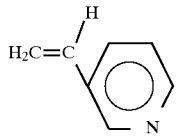

Production of Basic Dispersion Resin e

Basic dispersion resin e was produced in the same manner as basic dispersion resin a with the exception that 3 parts of N-vinylcarbazole having the chemical structure of [VI] below was substituted for N-vinyl-2-pyrrolidone as the basic monomer of dispersion

[VI]

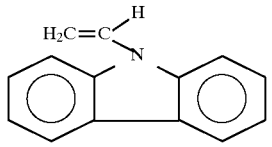

Production of Basic Dispersion Resin f

Basic dispersion resin f was produced in the same manner as basic dispersion resin a with the exception that 3 parts of dimethylaminoethylmethacrylate having the chemical structure of [VII] below was substituted for N-vinyl-2-pyrrolidone as the basic monomer of dispersion resin a.

[VII]

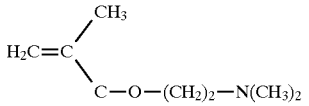

Production of Acidic Dispersion Resin q

Acidic dispersion resin g was produced by combining 100 parts IP solvent 1620 (Idemitsu Sekiyu Kagaku), 49 parts lauryl methacrylate, 1 part methacrylate having the chemical structure of [VIII] below as an acidic monomer, and 0.2 parts azobisisobutylonitrile as a polymerization initiator, and reacting said materials in a nitrogen atmosphere at a reaction temperature of 80°~90° C. for about 12 hr.

[VIII]

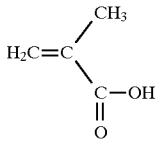

Production of Acidic Dispersion Resin h

Acidic dispersion resin h was produced in the same manner as acidic dispersion resin g with the exception that 1 part acrylic acid having the chemical structure of [IX] below was substituted for the methacrylic acid as the acidic monomer of acidic dispersion resin g.

[IX]

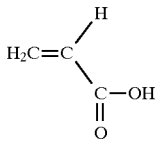

Production of Resin Microparticles A

One hundred parts low molecular weight polyester resin (Mw: 15,000; Mn: 6,000) were completely dissolved in toluene to achieve 1.5 percent-by-weight. Using an Eiger motor mill (Eiger Japan), 6 parts phthalocyanine pigment was dispersed as a colorant in the aforesaid resin solution.

The obtained resin solution was subjected to spray granulation using a dispacoate device (Nisshin Engineering) under conditions of 1 liter liquid supplied per hour, drying temperature of 80° C., spray pressure of 5.5 kgf/cm$^2$, to obtain spherical resin microparticles A having a mean size of 2.5 $\mu$m.

EXAMPLE 1

To 100 parts of electrically insulated medium of IP solvent 1620 (Idemitsu Sekiyu Kagaku) were added 1.5 parts basic dispersion resin a, and 1.5 parts acidic dispersion resin g, and the materials were thoroughly mixed for abut 30 min. After confirming that the dispersion resins were completed dissolved, 3 parts of the resin microparticles previously obtained by spray drying method were added, and the materials were dispersed using an ultrasonic dispersion device for about 20 min to obtain developer 1.

EXAMPLE 2

Developer 2 was produced in the same manner as developer 1 with the exception that basic dispersion resin b was substituted for the basic dispersion resin a of example 1.

EXAMPLE 3

Developer 3 was produced in the same manner as developer 1 with the exception that basic dispersion resin c was substituted for the basic dispersion resin a of developer 1.

EXAMPLE 4

Developer 4 was produced in the same manner as developer 1 with the exception that basic dispersion resin d was substituted for the basic dispersion resin a of example 1.

EXAMPLE 5

Developer 5 was produced in the same manner as developer 1 with the exception that basic dispersion resin e was substituted for the basic dispersion resin a of example 1.

EXAMPLE 6

Developer 6 was produced in the same manner as developer 1 with the exception that acidic dispersion resin h was substituted for the acidic dispersion resin g of example 1.

EXAMPLE 7

Developer 7 was produced in the same manner as developer 1 with the exception that the added amount of basic dispersion resin was 0.75 parts, and the amount of added acidic dispersion resin g was 2.25 parts.

EXAMPLE 8

Developer 8 was produced in the same manner as developer 1 with the exception that the added amount of basic dispersion resin was 2 parts, and the amount of added acidic dispersion resin g was 1 part.

EXAMPLE 9

Developer 9 was produced in the same manner as developer 1 with the exception that 1.5 parts basic dispersion resin f was substituted for basic dispersion resin a.

EXAMPLE 10

Example 10 was produced by adding 3 parts of the aforesaid resin microparticles to 100 parts IP solvent 1620 (Idemitsu Sekiyu Kagaku) without adding any basic dispersion resin or acidic dispersion resin, and mixing the materials for about 20 min using an ultrasonic dispersion device.

EXAMPLE 11

Example 11 was produced in the same manner as example 1 with the exception that 3 parts of acidic dispersion resin g were added without adding any basic dispersion resin.

EXAMPLE 12

Example 12 was produced in the same manner as example 1 with the exception that 3 parts of basic dispersion resin a was added without adding any acidic dispersion resin.

EXAMPLE 13

Example 13 was produced in the same manner as example 1 with the exception that 1.5 parts of pyridine was added as a basic compound in addition to basic dispersion resin a.

EXAMPLE 14

During the manufacturing process of resin microparticles, polyacrylate was blended with the polyester resin and a spray drying method identical to that of the examples was used to produce resin microparticles B having an acidic functional group on the particle surface. Example 14 was produced in the same manner as example 12 with the exception that resin microparticles B were substituted for the resin microparticles A of example 12, and basic dispersion resin f was substituted for the basic dispersion resin a.

Evaluations

The liquid developers of the aforesaid examples and reference examples were evaluated for developing speed, toner charging, and electrophoretic migration speed. The evaluation results are shown in Table 1.

Developing Speed

Evaluation of developing speed was accomplished using the liquid developing image forming apparatus shown in FIG. 1.

This image forming apparatus is described below.

In FIG. 1, reference number 1 refers to a photosensitive drum that rotates in the arrow direction. After the surface of photosensitive drum 1 is charged to about −1,000 V by a corotron charger 3, an electrostatic latent image is formed thereon by a laser beam scanner 4. Reference number 8 refers to a developer tank, which accommodates the previously described liquid developer. Reference number 2 refers to a developing roller which carries liquid developer from developer tank 8. The aforesaid electrostatic latent image is developed by the developer in the developing region opposite developing roller 2. At this time, the rotational speed of photosensitive drum 1 is variable, and the rotational speed of developing roller 2 is regulated so as to be a constant $\phi=10$ by a circumferential speed ratio with the photosensitive drum 1 (where $\phi$ is the (rotational speed of the developing roller)/(rotational speed of the photosensitive drum)).

Thereafter, the excess liquid developer remaining on the surface of the photosensitive drum is squeezed by a squeeze roller 5, so as to form a toner image containing some solvent on the surface of photosensitive drum 1. When the toner image is rotated to the transfer position opposite transfer roller 6, the toner image is electrostatically transferred to a paper sheet transported from another direction. At this time, a voltage of −1,000 V is applied to transfer roller 6. After the transfer sheet is separated from the photosensitive drum 1, it is transported to a pair of heat fixing rollers 7, which fuse the toner image thereon by heat and pressure, and one copy operation is thus completed.

The surface of the drum 1 is cleaned by cleaning roller 9 and cleaner blade 10 after the toner image fused thereon by heat and pressure.

Using the aforesaid image forming apparatus, solid images were formed while varying the speed of photosensitive drum 1, and the toner image density (ID) on the photosensitive drum was measured. The lower limit of ID at this time was standardized at 1.5; the maximum rotational speed of photosensitive drum 1 at which this ID was obtained was ranked below as the maximum developing speed; a ranking of Δ, indicating no practical problem, was passing. The measurement of image density ID was accomplished using a Macbeth Densitometer model PDA-65 (Konica).

A: Maximum developing speed of 500 mm/s or higher

B: Maximum developing speed of 200 mm/s or higher but less than 500 mm/s

C: Maximum developing speed of 50 mm/s or higher but less than 200 mm/s

D: Maximum developing speed of less than 50 mm/s

Charge Amount and Electrophoresis Speed

The various liquid developers of the previously described examples were loaded in electric conductivity measuring cells (model LE22; Ando Denki), and a voltage of 350 V was applied for 10 sec to accomplish electrophoresis. The toner particles migrated to the positive side. Electrode separation was about 1.5 mm, electrode surface area was about 28.7

$cm^2$, and the specimen volume was about 6.1 $cm^3$. The integral value of the current flowing during particle migration was recorded by an X–Y recorder, and was designated charge Q. The weight M of toner particles adhered to the electrode (positive side in the present examples) after electrophoresis for 10 sec was measured after adequate drying of the liquid medium, and the toner charge per unit weight Q/M(μc/g) was calculated. The results are shown in Table 1. The amount M/T of electrophoresed particles adhered to the electrode per unit time was calculated as electrophoresis speed (mg/s).These results are also shown in Table 1.

TABLE 1

| | Amt. Of Charge (μc/g) | Migration Speed (mg/s) | Developing Speed (mm/s) |
|---|---|---|---|
| Example 1 | −39.8 | 10.80 | A |
| Example 2 | −35.2 | 8.28 | A |
| Example 3 | −25.8 | 7.94 | A |
| Example 4 | −27.2 | 5.38 | B |
| Example 5 | −20.9 | 3.58 | B |
| Example 6 | −33.4 | 7.18 | A |
| Example 7 | −19.2 | 5.85 | B |
| Example 8 | −48.3 | 6.93 | A |
| Example 9 | −25.5 | 3.23 | B |
| Example 10 | −3.2 | 0.0 | D |
| Example 11 | −7.5 | 0.12 | D |
| Example 12 | −12.3 | 0.3 | C |
| Example 13 | −18.3 | 1.29 | C |
| Example 14 | −21.4 | 1.92 | C |

The liquid developer of the present invention exhibited excellent chargeability, and maintained adequate ID at high developing speeds to produce images with minimal noise such as fog and the like, as is clear from the data of Table 1.

Examples 14 exhibited charge levels similar to those of the embodiments of the present invention, but electrophoresis speed and developing speed were reduced.

In the above examples, the obtained polymers were random polymers, but alternating copolymers, block copolymers, graft copolymers and the like may be used without problem.

Production of Basic Dispersion Resin A

Ninety-five grams of lauryl methacrylate monomer were dissolved in 200 g of IP solvent 1620 (Idemitsu Sekiyu), and argon gas substitution was accomplished by total system blow reaction via infusion the argon gas in the solution for 10 min. Thereafter, benzoylperoxide (BPO) was added as a polymerization initiator at a rate of 1 molar percent relative to the monomer, and polymerization was maintained for 4 hr at a reaction system temperature of 80° C. Subsequently, 5 g of N-vinyl-2-pyrolidone monomer is added after the reaction system has been cooled to 30° C., and finally azobisisobutylnitrile (AIBN) is added at a rate of 1 molar percent relative to the monomer, and the reaction system is again heated to 90° C. and maintained for 4 hr to complete polymerization. The obtained liquid of lauryl methacrylate/N-vinyl-2-pryrolidone copolymer was designated basic dispersion resin A.

Production of Basic Dispersion Resin B

Ninety-five grams of lauryl methacrylate monomer were dissolved in 200 g of IP solvent 1620 (Idemitsu Sekiyu), and argon gas substitution was accomplished by total system blow reaction via infusion the argon gas in the solution for 10 min. Thereafter, benzoylperoxide (BPO) was added as a polymerization initiator at a rate of 1 molar percent relative to the monomer, and polymerization was maintained for 4 hr at a reaction system temperature of 80° C. Subsequently, 5 g of dimetylaminomethylmetaacrylate monomer is added after the reaction system has been cooled to 30° C., and finally azobisisobutylnitrile (AIBN) is added at a rate of 1 molar percent relative to the monomer, and the reaction system is again heated to 90° C. and maintained for 4 hr to complete polymerization. The obtained liquid of lauryl methacrylate/dimethylaminomethyl (meta)methacrylate copolymer was designated basic dispersion resin B.

EXAMPLE 15

| | |
|---|---|
| *Styrene/butylacrylate/acrylate copolymer (copolymer ratio: 70/25/5; acid value 12.3 mg KOH/g; Mn = 35,000; Mw = 3.0) | 100 pbw |
| *Carbon black (Mogal L; Cabot) | 20 pbw |

The mixture of the aforesaid components was kneaded for 4 hr at 180° C. using two rollers, subsequently cooled, then coarsely pulverized to obtain coarse colored particles having a mean particle size of about 100 μm.

These coarse colored particles were dispersed with the following materials in prepulverization at 2,000 rpm for 2 hr by sand mill using soda glass beads 5.0 mm in diameter as the media.

| | |
|---|---|
| *Coarsely pulverized colored particles | 30 pbw |
| *Basic dispersion resin A | 5 pbw |
| *IP solvent 1620 (Idemitsu Sekiyu Kagaku) (Volume resistivity: $1.5 \times 10^{14}$ Ωcm) | 100 pbw |

Then, the soda glass beads were changed to beads having a diameter of 1.0 mm, and wet pulverization dispersion was continued for 4 hr at 2,000 rpm to obtain a thick liquid developer.

To this thick liquid developer was added 900 parts IP solvent 1620, then 5,000 ppm water was added and the material was again dispersed for 1 hr using a sand mill to obtain a liquid developer. The volume-average particle size of colored particles (toner particles) in the liquid developer was 1.5 μm, and the volume resistivity of the liquid developer was $2.3\times10^{13}$ Ωcm.

EXAMPLE 16

A liquid developer was obtained in the same manner as in example 15 with the exception that 500 ppm water was added. The volume-average particle size of toner particles in the liquid developer was 1.5 μm, and the volume resistivity of the liquid developer was $2.1\times10^{13}$ Ωcm.

EXAMPLE 17

A liquid developer was obtained in the same manner as in example 15 with the exception that 20,000 ppm water was added. The volume-average particle size of toner particles in the liquid developer was 1.5 μm, and the volume resistivity of the liquid developer was $1.5\times10^{13}$ Ωcm.

EXAMPLE 18

A liquid developer was obtained in the same manner as in example 15 with the exception that 10 parts basic dispersion resin A was added. The volume-average particle size of toner particles in the liquid developer was 1.5 μm, and the volume resistivity of the liquid developer was $8.5\times10^{12}$ Ωcm.

EXAMPLE 19

A liquid developer was obtained in the same manner as in example 15 with the exception that 15 parts basic dispersion resin A was added. The volume-average particle size of toner particles in the liquid developer was 1.5 μm, and the volume resistivity of the liquid developer was $5.7\times10^{12}$ Ωcm.

EXAMPLE 20

A liquid developer was obtained in the same manner as in example 15 with the exception that 20 parts basic dispersion resin A was added. The volume-average particle size of toner particles in the liquid developer was 1.5 Ωm, and the volume resistivity of the liquid developer was $1.9\times10^{12}$ Ωcm.

EXAMPLE 21

A liquid developer was obtained in the same manner as in example 15 with the exception that styrene/butylacrylate/acrylate copolymer (copolymer ratio: 70/20/10; acid value: 25.7 mgKOH/g; Mn=32,000; Mw/Mn=2.9) was used as the binder resin of the colored particles. The volume-average particle size of toner particles in the liquid developer was 1.6 μm, and the volume resistivity of the liquid developer was $2.2\times10^{13}$ Ωcm.

EXAMPLE 22

A liquid developer was obtained in the same manner as in example 15 with the exception that styrene/butylacrylate/acrylate copolymer (copolymer ratio: 60/20/20; acid value: 36.8 mgKOH/g; Mn=32,000; Mw/Mn=2.9) was used as the binder resin of the colored particles. The volume-average particle size of toner particles in the liquid developer was 1.6 μm, and the volume resistivity of the liquid developer was $2.1\times10^{13}$ Ωcm.

EXAMPLE 23

A liquid developer was obtained in the same manner as in example 15 with the exception that styrene/butylacrylate/acrylate copolymer (copolymer ratio: 70/29.5/0.5; acid value: 1.1 mgKOH/g; Mn=33,000; Mw/Mn=2.7) was used as the binder resin of the colored particles, and 2 parts silica (R-974; Nippon-Aerosil) were added to the colored particles. The volume-average particle size of toner particles in the liquid developer was 1.6 μm, and the volume resistivity of the liquid developer was $2.3\times10^{13}$ Ωcm.

EXAMPLE 24

A liquid developer was obtained in the same manner as in example 23 with the exception that 5 parts silica (R-974; Nippon-Aerosil) were added to the colored particles. The volume-average particle size of toner particles in the liquid developer was 1.5 μm, and the volume resistivity of the liquid developer was $2.3\times10^{13}$ Ωcm.

EXAMPLE 21

A liquid developer was obtained in the same manner as in example 15 with the exception that 5 parts silica (R-974: Nippon-Aerosil) were added to the colored particles, and 5 parts basic dispersion resin B were substituted for basic dispersion resin A. The volume-average particle size of toner particles in the liquid developer was 1.5 μm, and the volume resistivity of the liquid developer was $8.7\times10^{12}$ Ωcm.

EXAMPLE 26

| | |
|---|---|
| *Styrene/butylacrylate/acrylate copolymer (copolymer ratio: 70/25/5; acid value 12.3 mg KOH/g; Mn = 35,000; Mw = 3.0) | 100 pbw |
| *Carbon black (Mogal L; Cabot) | 20 pbw |

The mixture of the aforesaid components was kneaded for 4 hr at 180° C. using two rollers, subsequently cooled, then coarsely pulverized to obtain coarse colored particles having a mean particle size of about 100 μm.

These coarsely pulverized colored particles were then finely pulverized using a jet mill (Japan Pneumatic) to obtain toner particles having a volume-average particle size of 1.7 μm.

These toner particles were dispersed with the following materials at 2,000 rpm for 1 hr by sand mill using soda glass beads 1.0 mm in diameter as the media to obtain a thick liquid developer.

| | |
|---|---|
| *Above toner particles | 30 pbw |
| *Basic dispersion resin A | 5 pbw |
| *IP solvent 1620 (Idemitsu Sekiyu Kagaku) | 100 pbw |

To this thick liquid developer were added 900 parts IP solvent 1620, then 5,000 ppm water was added and the material was again dispersed for 1 hr using a sand mill to obtain a liquid developer. The volume-average particle size of colored particles (toner particles) in the liquid developer was 1.7 μm, and the volume resistivity of the liquid developer was $2.3\times10^{13}$ Ωcm.

EXAMPLE 27

A liquid developer was obtained in the same manner as in example 15 with the exception that polyester resin (Viron; acid value: 1.68 mgKOH/g; Mw=15,000~20,000; Toyobo Co., Ltd.) was used as the binder resin of the colored particles, and 2 parts silica (R-974; Nippon-Aerosil) were added to the colored particles. The volume-average particle size of toner particles in the liquid developer was 1.5 μm, and the volume resistivity of the liquid developer was $1.9\times10^{13}$ Ωcm.

EXAMPLE 28

A liquid developer was obtained in the same manner as in example 15 with the exception that basic dispersion resin A was omitted. The volume-average particle size of toner particles in the liquid developer was 1.5 μm, and the volume resistivity of the liquid developer was $8.3\times10^{13}$ Ωcm.

EXAMPLE 29

A liquid developer was obtained in the same manner as in example 15 with the exception that 100 ppm water was added. The volume-average particle size of toner particles in the liquid developer was 1.5 μm, and the volume resistivity of the liquid developer was $7.8\times10^{13}$ Ωcm.

EXAMPLE 30

A liquid developer was obtained in the same manner as in example 15 with the exception that 25,000 ppm water was added. The volume-average particle size of toner particles in the liquid developer was 1.5 μm, and the volume resistivity of the liquid developer was $1.3\times10^{9}$ Ωcm.

EXAMPLE 31

A liquid developer was obtained in the same manner as in example 15 with the exception that styrene/butylacrylate copolymer (copolymer ratio: 75/25; acid value: 0 mgKOH/g; Mn=34,000; Mw/Mn=2.8) was used as the binder resin of the colored particles. The volume-average particle size of toner particles in the liquid developer was 1.7 $\mu$m, and the volume resistivity of the liquid developer was $2.3\times10^{13}$ Ωcm.

The liquid developers of the aforesaid examples were each evaluated for chargeability, image density, image resolution, and offset characteristics.

Image density and image resolution evaluations were conducted using the image forming apparatus shown in FIG. 1.

The measurement of image density ID was accomplished using a Macbeth Densitometer model PDA-65 (Konica) to measure the image density of a solid image obtained using the previously mentioned image forming apparatus (fixing roller temperature: 160° C.).

Image resolution was evaluated by developing fine lines of 10~50 lines/mm, and determining the maximum value of the number of fine lines per millimeter completely reproduced on the photosensitive member, and using this value as the resolution. A resolution of 25 lines/mm or greater is desirable, and a resolution of 30 lines/mm or greater is preferred.

Evaluation of chargeability of the liquid developers was accomplished by measuring the amount of charge on the toner particles in the liquid developer under three environmental states of high temperature and high humidity (HH; 35° C., 85% RH), normal temperature and normal humidity (NN; 25° C., 60% RH), and low temperature and low humidity (LL; 10° C., 30% RH), and determining the fluctuation range of the amount of charge and the absolute value of the charge.

The method of measuring the charge of the toner particles in the liquid developer is described below.

The liquid developer to be measured was injected between two electrodes spaced 1.5 mm apart, and a potential difference of 300 V was applied between said electrodes for 10 sec. The toner particles in the liquid developer electrophoretically migrated in the direction of the positive electrode due to the aforesaid potential difference, and adhered to the surface of said electrode. The integral value Q of the current flowing during particle migration was read by a Coulomb meter, and the weight M of toner particles adhered to the electrode after electrophoresis was determined, and the toner charge per unit weight Q/M was calculated. In table 2, the charge in example 30 is negative, because accurate charge measurement could not be completed due to the low resistance value of the developing liquid.

Offset characteristics were evaluated by measuring the presence or absence of offset with respect to the surface temperature of the fixing roller, to determine the temperature range of anti-offset.

The moisture content was measured by the Karl Fischer technique.

The toner particles were measured using a laser diffraction type particle distribution measuring device model SALD-1100 (Shimadzu).

Evaluation results are shown in Table 2.

TABLE 2

| | Amt. Of Charge Q/M (−$\mu$C/g) | | | Image Density | | | Resolution ( /mm) | | | Anti-offset Range |
|---|---|---|---|---|---|---|---|---|---|---|
| | HH | NN | LL | HH | NN | LL | HH | NN | LL | (°C.) |
| Example 15 | 23.5 | 23.0 | 22.9 | 1.4 | 1.4 | 1.4 | 50 | 50 | 50 | 100~180 |
| Example 16 | 23.4 | 23.2 | 23.0 | 1.4 | 1.4 | 1.4 | 50 | 50 | 50 | 90~180 |
| Example 17 | 23.6 | 23.5 | 23.5 | 1.4 | 1.4 | 1.4 | 50 | 50 | 50 | 120~180 |
| Example 18 | 43.4 | 43.1 | 42.9 | 1.3 | 1.3 | 1.3 | 50 | 50 | 50 | 90~180 |
| Example 19 | 73.4 | 73.0 | 72.9 | 1.0 | 1.0 | 1.0 | 50 | 50 | 50 | 90~180 |
| Example 20 | 73.3 | 73.1 | 72.9 | 1.0 | 1.0 | 1.0 | 50 | 50 | 50 | 90~180 |
| Example 21 | 42.3 | 42.2 | 42.2 | 1.3 | 1.3 | 1.3 | 50 | 50 | 50 | 100~175 |
| Example 22 | 61.5 | 61.2 | 61.0 | 1.2 | 1.2 | 1.2 | 50 | 50 | 50 | 110~175 |
| Example 23 | 30.3 | 30.2 | 30.1 | 1.3 | 1.3 | 1.3 | 50 | 50 | 50 | 100~180 |
| Example 24 | 40.1 | 40.1 | 40.0 | 1.3 | 1.3 | 1.3 | 50 | 50 | 50 | 105~180 |
| Example 25 | 20.1 | 19.9 | 19.8 | 1.4 | 1.4 | 1.4 | 50 | 50 | 50 | 90~180 |
| Example 26 | 23.4 | 23.2 | 23.2 | 1.4 | 1.4 | 1.4 | 50 | 50 | 50 | 100~180 |
| Example 27 | 31.2 | 31.2 | 31.1 | 1.3 | 1.3 | 1.3 | 50 | 50 | 50 | 90~180 |
| Example 28 | 2.1 | 2.0 | 1.9 | 0.8 | 0.8 | 0.8 | 10 | 12 | 10 | 90~180 |
| Example 29 | 11.6 | 8.9 | 2.1 | 1.1 | 0.9 | 0.8 | 40 | 15 | 10 | 80~180 |
| Example 30 | — | — | — | 0.5 | 0.5 | 0.5 | 6 | 6 | 6 | 140~180 |
| Example 31 | 2.2 | 2.3 | 2.1 | 0.8 | 0.8 | 0.8 | 10 | 11 | 11 | 100~180 |

Obviously, many modifications and variations of the present invention are possible in light of the above teachings. It is therefore to be understood that within the scope of the appended claims, the invention may be practiced other than as specifically described.

What is claimed is:

1. A liquid developer comprising:

carrier liquid, and toner particles, dispersed in the carrier liquid, formed of binder resin and colorant, wherein said carrier liquid contains acidic dispersion resin and basic dispersion resin which are soluble in said carrier liquid, said liquid developer having a moisture content of 500–20,000 ppm.

2. The liquid developer of claim 1 wherein the toner particles is obtained by wet type pulverization method in which an isoparaffin solvent is used with a media mill.

3. The liquid developer of claim 1 wherein the colorant are used at a rate of 3–30 parts-by-weight to 100 parts-by-weight of the binder resin.

4. The liquid developer of claim 1 wherein the volume-average particle size of the toner particles is in a range of 0.5–5.0 μm.

5. The liquid developer of claim 1 wherein the binder resin is selected from the group consisting of polyester resin, styrene-acrylic copolymer, polystyrene, polyvinylchloride, polyvinylacetate, polymethacrylate ester, polyacrylate ester, epoxy resin, polyethylene, polyurethane, polyamide and paraffin wax.

6. The liquid developer of claim 1 wherein the basic dispersion resin contains nitrogen containing basic monomers.

7. The liquid developer of claim 6 wherein the nitrogen containing basic monomers is selected from the group consisting of (meta) acrylates having an aliphatic amino group, (meta)acrylamides, aromatic substituted ethylene monomers having a nitrogen group, nitrogen containing vinyl ether monomers, and nitrogen containing heterocyclic compounds.

8. The liquid developer of claim 6 wherein the basic dispersion resin has a basic backbone structure of pyrolizine or oxazine.

9. The liquid developer of claim 6 wherein the nitrogen containing basic monomers comprise 0.1 to 30 percent-by-weight in the dispersion resin.

10. The liquid developer of claim 6 wherein the nitrogen containing basic monomers is 1 to 80 percent-by-weight with respect to the toner particles.

11. The liquid developer of claim 1 wherein the acidic dispersion resin contains acidic monomer selected from the group consisting of carboxyl group, sulfonic groups, sulfinic groups and metal salts thereof.

12. The liquid developer of claim 1 wherein the amount of dispersion resin is 0.1 to 20 percent-by-weight.

13. The liquid developer of claim 1 wherein the ratio of the basic dispersion resin and the acidic dispersion resin is 1:5 to 5:1.

14. The liquid developer of claim 1 wherein the the carrier liquid has a resistance of $10^{11}$~$10^{16}$ Ωcm.

15. The liquid developer of claim 1 wherein the concentration of toner particles relative to carrier liquid is 0.5 to 50 percent-by-weight.

16. A liquid developer for electrophotography comprising:

carrier liquid, and toner particles, dispersed in the carrier liquid, formed of binder resin and colorant, wherein said liquid developer contains a basic dispersion resin that is soluble in said carrier liquid and has a moisture content of 500–20,000 ppm, and has an acidic group on the surface of the toner particle.

17. The liquid developer of claim 16 wherein the moisture content of 1000–15,000 ppm.

18. The liquid developer of claim 16 wherein the acidic group on the surface of the toner particle is obtained by using resin having an acid group as the binder resin having an acid value of 5 to 100 mgKOH/g.

19. The liquid developer of claim 16 wherein the acidic group on the surface of the toner particle is obtained by including compound having an acid group into the binder resin.

20. The liquid developer of claim 16 wherein the acidic group on the surface of the toner particle is obtained by anchoring acidic microparticles to the surface of the toner particles.

21. The liquid developer of claim 16 wherein the basic dispersion resin contains nitrogen containing basic monomers.

22. The liquid developer of claim 21 wherein the nitrogen containing basic monomers is selected from the group consisting of (meta) acrylates having an aliphatic amino group, (meta)acrylamides, aromatic substituted ethylene monomers having a nitrogen group, nitrogen containing vinyl ether monomers, and nitrogen containing heterocyclic compounds.

23. A liquid developer comprising:

carrier liquid; and toner particles, dispersed in the carrier liquid, formed of a binder resin and colorant, wherein said carrier liquid contains acidic dispersion resin and a basic dispersion resin which are soluble in said carrier liquid, said basic dispersion resin comprising a basic heterocyclic compound containing nitrogen atoms, said liquid developer having a moisture content of 500–20,000 ppm.

24. A liquid developer comprising:

carrier liquid; and toner particles, dispersed in the carrier liquid, formed of a binder resin and colorant, wherein said carrier liquid contains acidic dispersion resin and basic dispersion resin which are soluble in said carrier liquid, said basic dispersion resin having a basic backbone structure of pyrolizine or oxazine and being copolymer or methacrylate ester having an alkyl group with 10–20 carbon atoms, said liquid developer having a moisture content of 500–20,000 ppm.

* * * * *